US011466836B1

(12) United States Patent
Cheng

(10) Patent No.: US 11,466,836 B1
(45) Date of Patent: Oct. 11, 2022

(54) OPTICAL APPARATUS WITH TILTED LIGHT SOURCE

(71) Applicant: HIMAX TECHNOLOGIES LIMITED, Tainan (TW)

(72) Inventor: Yu-Ching Cheng, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 0 days.

(21) Appl. No.: 17/659,657

(22) Filed: Apr. 18, 2022

(51) Int. Cl.
*F21V 5/00* (2018.01)

(52) U.S. Cl.
CPC ..... *F21V 5/004* (2013.01); *F21V 5/00* (2013.01); *F21V 5/002* (2013.01)

(58) Field of Classification Search
CPC ..... F21V 5/00; F21V 5/002
See application file for complete search history.

*Primary Examiner* — Robert J May
(74) *Attorney, Agent, or Firm* — CKC & Partners Co., LLC

(57) ABSTRACT

The optical apparatus includes a first light source, a second light source, and at least one lens unit. An incident surface of the lens unit faces the first light source and the second light source. The normal vector of a first emitting surface of the first light source is tilted toward a first direction opposite to the second light source. The normal vector of a second emitting surface of the second light source is tilted toward a second direction opposite to the first light source. The first direction is opposite to the second direction such that an angle is formed between the normal vector of the first emitting surface and the normal vector of the second emitting surface. The angle is greater than 0 degree and less than or equal to 90 degrees.

10 Claims, 6 Drawing Sheets

OPTICAL APPARATUS WITH TILTED LIGHT SOURCE

BACKGROUND

Field of Invention

The present invention relates to a device for light scattering control.

Description of Related Art

In a conventional light scattering device, a light source is paired with a lens to produce a particular field of view which may be adjusted according to the profile of the lens. However, the field of view is limited by Snell's law. When the field of view increases, the profile of the lens become steep and difficult for fabrication. Therefore, it is an issue in the art about how to provide a wide field of view.

SUMMARY

Embodiments of the present disclosure provide an optical apparatus including a first light source having a first emitting surface, a second light source having a second emitting surface, and at least one lens unit. The second light source and the first light source are arranged along a first direction. The first light source and the second light source are disposed at a same side of the lens unit, and an incident surface of the lens unit faces the first light source and the second light source. The normal vector of the first emitting surface is tilted a first angle toward the first direction opposite to the second light source. The normal vector of the second emitting surface is tilted a second angle toward a second direction opposite to the first light source. The first direction is opposite to the second direction such that a third angle is formed between the normal vector of the first emitting surface and the normal vector of the second emitting surface. The third angle is greater than 0 degree and less than or equal to 90 degrees.

In some embodiments, the first light source and the second light source are vertical-cavity surface-emitting lasers (VCSEL), edge emitting lasers or light-emitting diodes. The lens unit is a micro-lens array (MLA) or a diffractive optical element (DOE).

In some embodiments, the first angle is identical to the second angle. The first angle is greater than 0 degree and less than or equal to 45 degrees.

In some embodiments, the first angle is different from the second angle.

In some embodiments, the at least one lens unit includes a first lens unit and a second lens unit. The first lens unit corresponds to the first light source, and the second lens unit corresponds to the second light source.

In some embodiments, the normal vector of an emitting surface of the first lens unit is tilted toward the first direction. The normal vector of an emitting surface of the second lens unit is tilted toward the second direction. Multiple micro-lens are formed on an incident surface of the first lens unit, and an incident surface of each of the micro-lens is symmetric with respect to an optical axis of the corresponding micro-lens. The first lens unit is identical to the second lens unit.

In some embodiments, incident surfaces of the micro-lens on the first lens unit and the second lens unit are symmetric, but the first lens unit is different from the second lens unit.

In some embodiments, the normal vector of an emitting surface of the first lens unit is tilted toward the first direction. The normal vector of an emitting surface of the second lens unit is tilted toward the second direction. Multiple first micro-lens are formed on a first incident surfaces of the first lens unit. The optical axis of each of the first micro-lens is tilted toward the first direction on the first incident surface such that the optical axis of each of the first micro-lens is not parallel to the normal vector of the emitting surface of the first lens unit.

In some embodiments, multiple second micro-lens are formed on a second incident surface of the second lens unit. The optical axis of each of the second micro-lens is tilted toward the second direction on the second incident surface such that the optical axis of each of the second micro-lens is not parallel to the normal vector of the emitting surface of the second lens unit.

In some embodiments, an incident surface of each of the first micro-lens is asymmetric with respect to the optical axis of the corresponding first micro-lens. An incident surface of each of the second micro-lens is asymmetric with respect to the optical axis of the corresponding second micro-lens.

BRIEF DESCRIPTION OF THE DRAWINGS

The invention can be more fully understood by reading the following detailed description of the embodiment, with reference made to the accompanying drawings as follows.

DETAILED DESCRIPTION

Specific embodiments of the present invention are further described in detail below with reference to the accompanying drawings, however, the embodiments described are not intended to limit the present invention and it is not intended for the description of operation to limit the order of implementation. Moreover, any device with equivalent functions that is produced from a structure formed by a recombination of elements shall fall within the scope of the present invention. Additionally, the drawings are only illustrative and are not drawn to actual size.

The using of "first", "second", "third", etc. in the specification should be understood for identifying units or data described by the same terminology, but are not referred to particular order or sequence.

Figure 1:
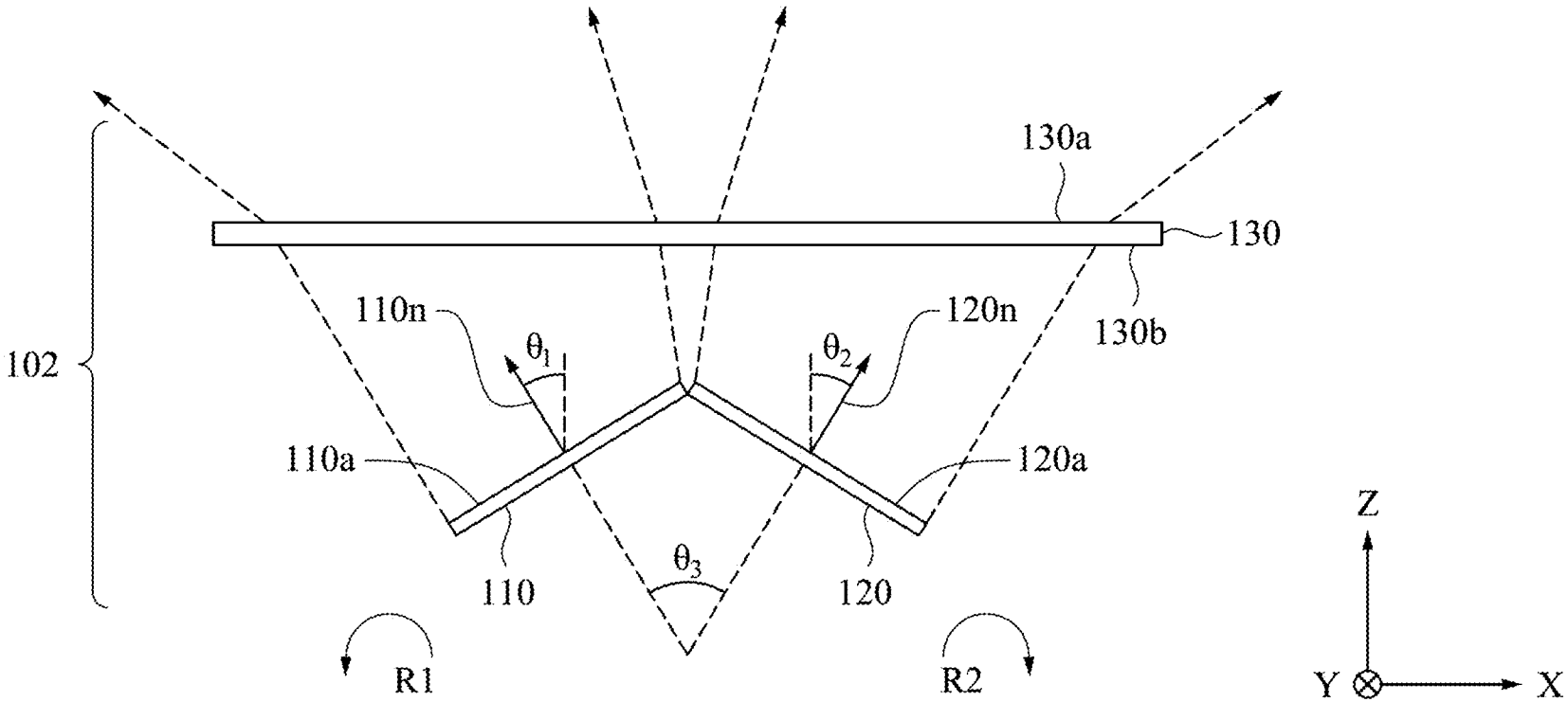
FIG. 1 is a schematic diagram of an optical apparatus in accordance with an embodiment.

FIG. 1 is a schematic diagram of an optical apparatus in accordance with an embodiment. Referring to FIG. 1, an optical apparatus 102 may be disposed in a head-mounted device, a projector, or any other suitable devices. For example, the optical apparatus 102 can emit diffused light onto a target object, and the reflective intensity is received by another optical sensor for calculating depth of the field. In some embodiments, the optical apparatus 102 emit light onto a transparent substrate in the head-mounted device such as glasses.

The optical apparatus 102 includes a light source 110, a light source 120, and a lens unit 130. The light source 110 and the light source 120 are, for example, vertical-cavity surface-emitting lasers (VCSEL), edge emitting lasers, light-emitting diodes (LED), etc. The lens unit 130 is, for example, a micro-lens array (MLA) or a diffractive optical element (DOE). The MLA may be a random MLA in which micro-lens are distributed randomly or a regular MLA in which the spaces between the micro-lens are the same. The MLA may be a convex lens array or a concave lens array which is not limited in the disclosure.

The light source 110 has an emitting surface 110*a*, and the light source 120 has an emitting surface 120*a*. The lens unit 130 has an incident surface 130*b* and an emitting surface 130*a*. The light source 110 and the light source 120 are disposed at the same side of the lens unit 130, and the incident surface 130*b* of the lens unit 130 faces the light source 110 and the light source 120. The emitting surface 110*a* has a normal vector 110*n*, and the emitting surface 120*a* has a normal vector 120*n*. Herein, the light source 110 and the light source 120 are arranged along the X direction, light is projected onto a X-Y plane, and the light source 110 (light source 120) and the lens unit 130 are arranged along the Z direction. The X, Y, and Z directions are perpendicular to each other. In the conventional art, the normal vector 110*n* is parallel to the normal vector 120*n*, and they are both toward the Z direction. However, in the embodiment, the normal vector 110*n* is tilted a first angle $\theta_1$ toward a first direction (i.e. −X direction) opposite to the light source 120. The normal vector 120*n* is tilted a second angle $\theta_2$ toward a second direction (i.e. X direction) opposite to the light source 110. The first direction is opposite to the second direction. After the normal vectors are tilted, a third angle $\theta_3$ is formed between the normal vector 110*n* and the normal vector 120*n*. The third angle $\theta_3$ is greater than 0 degree and less than or equal to 90 degrees. From another aspect, the normal vector 110*n* is tilted relative to the Z direction such that the first angle $\theta_1$ is formed between the normal vector 110*n* and the Z direction. The normal vector 120*n* is tilted relative to the Z direction such that a second angle $\theta_2$ is formed between the normal vector 120*n* and the Z direction. In other words, the light source 110 and the light source 120 are tilted outward relative to the Z direction in which the light source 110 is rotated along a first rotation direction R1 and the light source 120 is rotated along a second rotation direction R2 which is opposite to the first rotation direction R1. In the embodiment of FIG. 1, the first rotation direction R1 is counterclockwise, and the second rotation direction R2 is clockwise.

Figure 2:
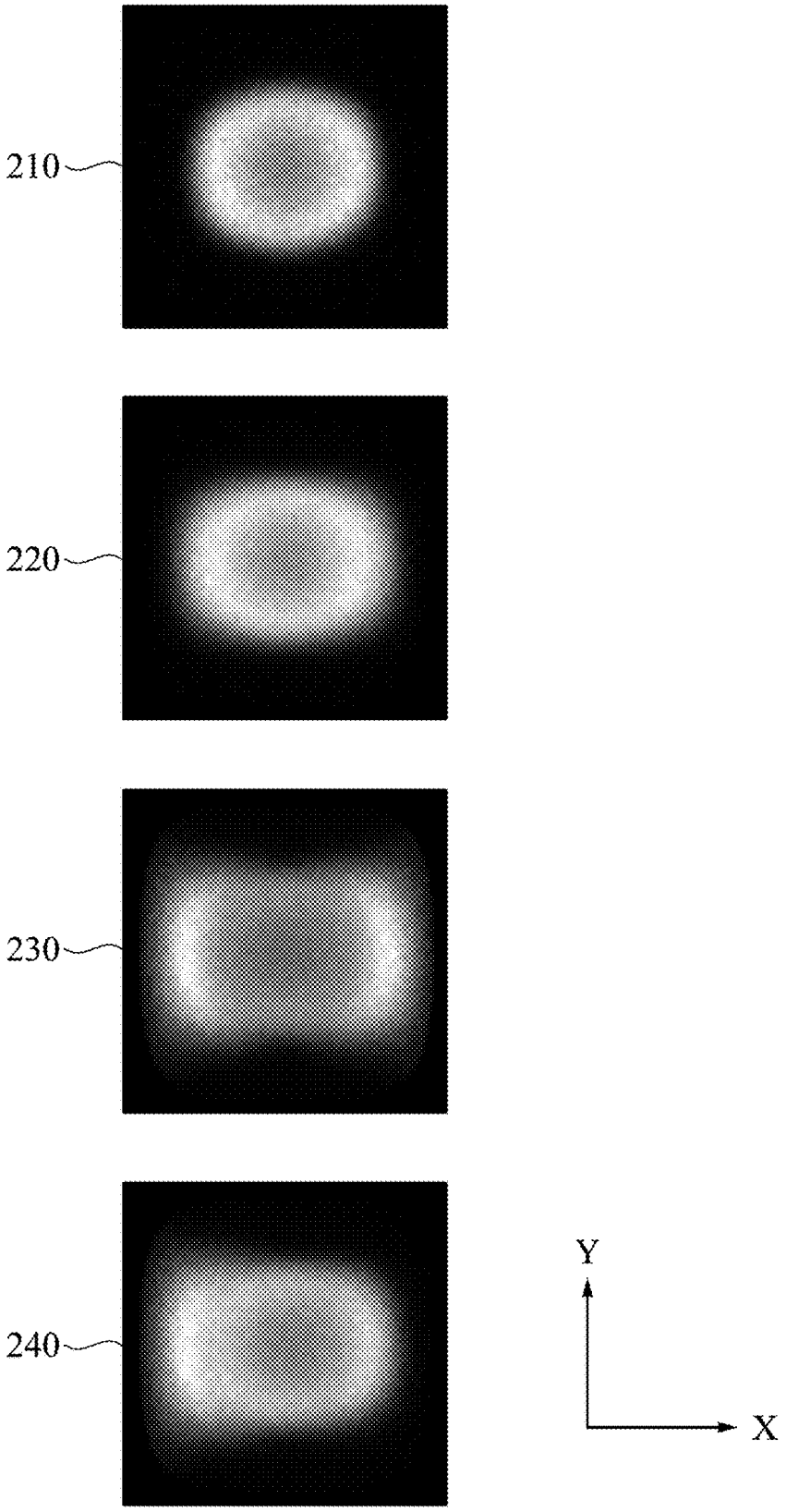
FIG. 2 is a diagram of intensity distribution with respect to different angles.

After the normal vector 110*n* and the normal vector 120*n* are tilted, the incident angle of the light into the lens unit 130 becomes larger, resulting in that the field of view (FOV) increases. The first angle $\theta_1$ may be identical to or different from the second angle $\theta_2$. In some embodiments, the first angle $\theta_1$ and the second angle $\theta_2$ are greater than 0 degree and less than or equal to 45 degrees. FIG. 2 is a diagram of intensity distribution with respect to different angles. Referring to FIG. 2, the intensity distribution is illustrated on the X-Y plane. When $\theta_1=\theta_2=0°$, an intensity distribution 210 is produced where the horizontal FOV (i.e. X direction plus −X direction) is 104.94 degrees, and the vertical FOV i.e. Y direction plus −Y direction) is 91.93 degrees; when $\theta_1=\theta_2=10°$, an intensity distribution 220 is produced where the horizontal FOV is 121.99 degrees and the vertical FOV is 92.64 degrees; when $\theta_1=\theta_2=20°$, an intensity distribution 230 is produced where the horizontal FOV is 153.45 degrees and the vertical FOV is 94.58 degrees; when $\theta_1=20°$, $\theta_2=10°$, an intensity distribution 240 is produced where the horizontal FOV of the −X direction is 74 degrees, the horizontal FOV of X direction is 62.23 degrees, and the vertical FOV is 91.93 degrees. Therefore, the tilt of the light source 110 and 120 can increase the horizontal FOV.

In some embodiments, the light source 110 and the light source 120 may be arranged along the Y direction. The normal vector 110*n* and the normal vector 120*n* may be tilted toward the −Y direction and Y direction respectively to increase the vertical FOV. In some embodiments, there are multiple light sources, some of them are tilted toward the X direction, some of them are tilted toward the −X direction, some of them are tilted toward the Y direction, and some of them are tilted toward −Y direction. The number of the light sources is not limited in the disclosure.

Figure 3:
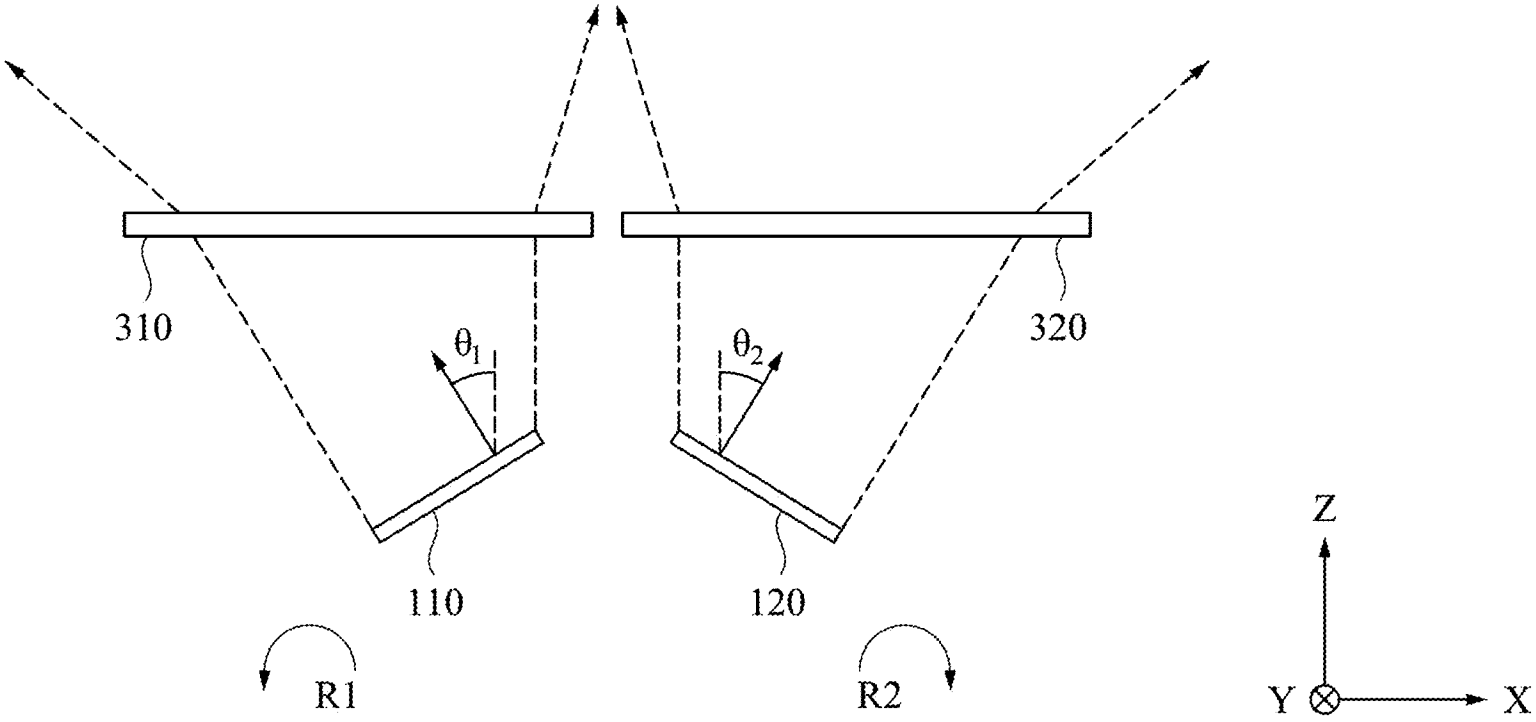
FIG. 3 is a schematic diagram of an optical apparatus in accordance with an embodiment.

FIG. 3 is a schematic diagram of an optical apparatus in accordance with an embodiment. There are two lens units 310 and 320 in the embodiment of FIG. 3. The lens unit 310 corresponds to the light source 110, and the lens unit 320 corresponds to the light source 120. In the embodiment, the light sources 110 and 120 are tilted, but the lens units 310 and 320 are not tilted.

Figure 4:
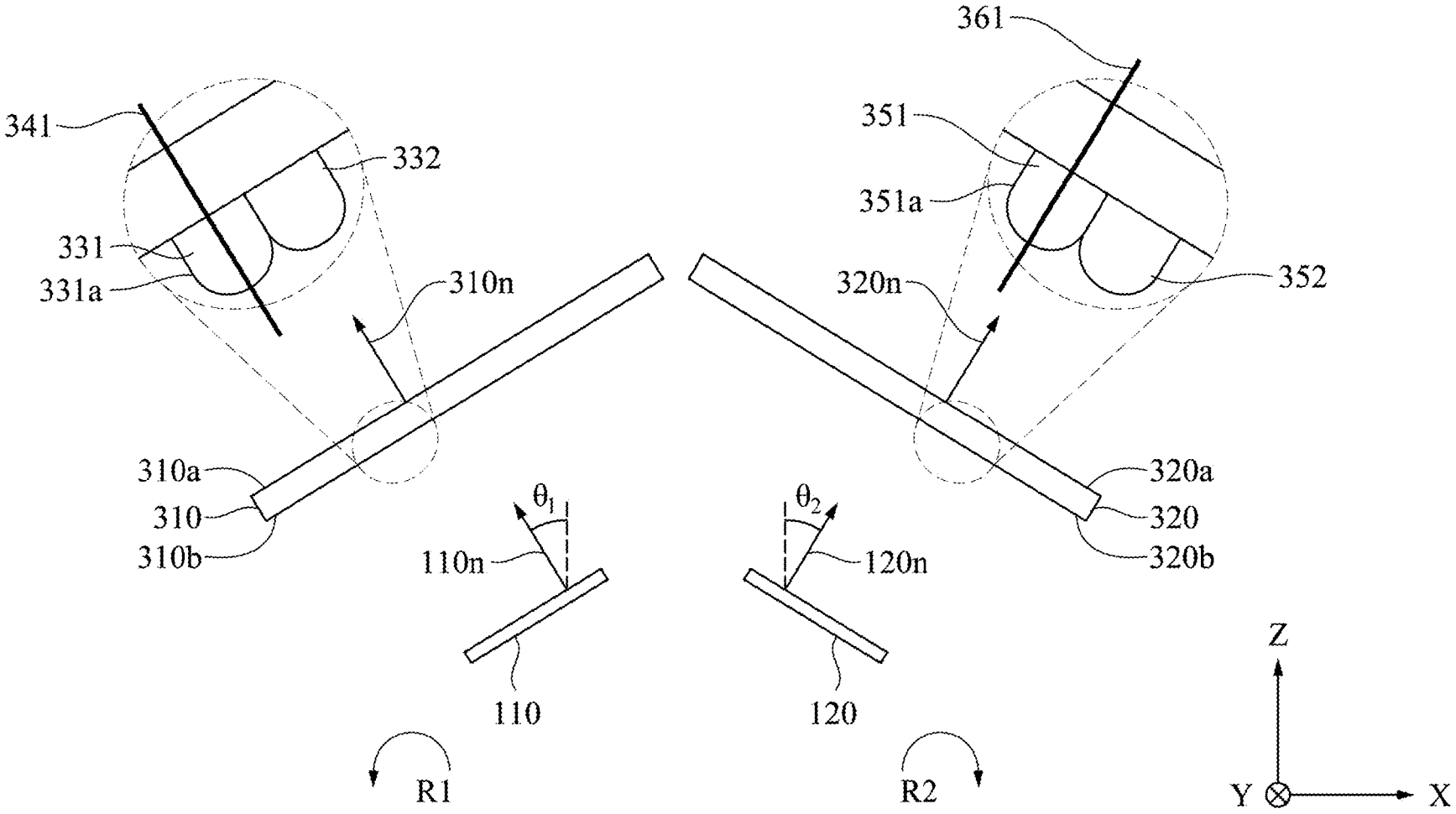
FIG. 4 is a schematic diagram of an optical apparatus in accordance with an embodiment.

FIG. 4 is a schematic diagram of an optical apparatus in accordance with an embodiment. There are two lens units 310 and 320 in the embodiment of FIG. 4. The lens unit 310 has an emitting surface 310*a* and an incident surface 310*b*. The emitting surface 310*a* has a normal vector 310*n* which is tilted toward the −X direction. In other words, the lens unit 310 is rotated along the first rotation direction R1. The lens unit 320 has an emitting surface 320*a* and an incident surface 320*b*. The emitting surface 320*a* has a normal vector 320*n* which is tilted toward the X direction. In other words, the lens unit 320 is rotated along the second rotation direction R2. In the embodiment, the first angle $\theta_1$ is identical to the second angle $\theta_2$, the normal vector 310*n* is parallel to the normal vector 110*n*, and the normal vector 320*n* is parallel to the normal vector 120*n*. In other embodiments, the normal vector 310*n* may not be parallel to the normal vector 110*n*, or the normal vector 320*n* may not be parallel to the normal vector 120*n*.

The lens unit 310 is identical to the lens unit 320 in some embodiments, and that is, micro-lens of one lens unit are identical to those of the other lens unit. In detail, multiple micro-lens are formed on the incident surface 310*b* of the lens unit 310 in which an enlarged diagram of micro-lens 331 and 332 are shown in FIG. 4. The optical axis 341 of the micro-lens 331 is not tilted relative to the normal vector 310*n*, and that is, the optical axis 341 is parallel to the normal vector 310*n*. For example, an incident surface 331*a* of the micro-lens 331 is symmetric with respect to the optical axis 341. Similarly, multiple micro-lens are formed on the incident surface 320*b* of the lens unit 320 in which an enlarged diagram of micro-lens 351 and 352 are shown in FIG. 4. The optical axis 361 of the micro-lens 351 is not tilted relative to the normal vector 320*n*, and that is, the optical axis 361 is parallel to the normal vector 320*n*. For example, an incident surface 351*a* of the micro-lens 351 is symmetric with respect to the optical axis 361. In some embodiments, the micro-lens 351-352 and the micro-lens 331-332 are symmetric, but the lens unit 310 is different from the lens unit 320. For example, the distribution of the micro-lens 331-332 on the lens unit 310 is different from the distribution of the micro-lens 351-352 on the lens unit 320. In some embodiment, the profiles of the micro-lens 331-332 are different from (e.g. steeper than) that of the micro-lens 351-352.

Figure 5:
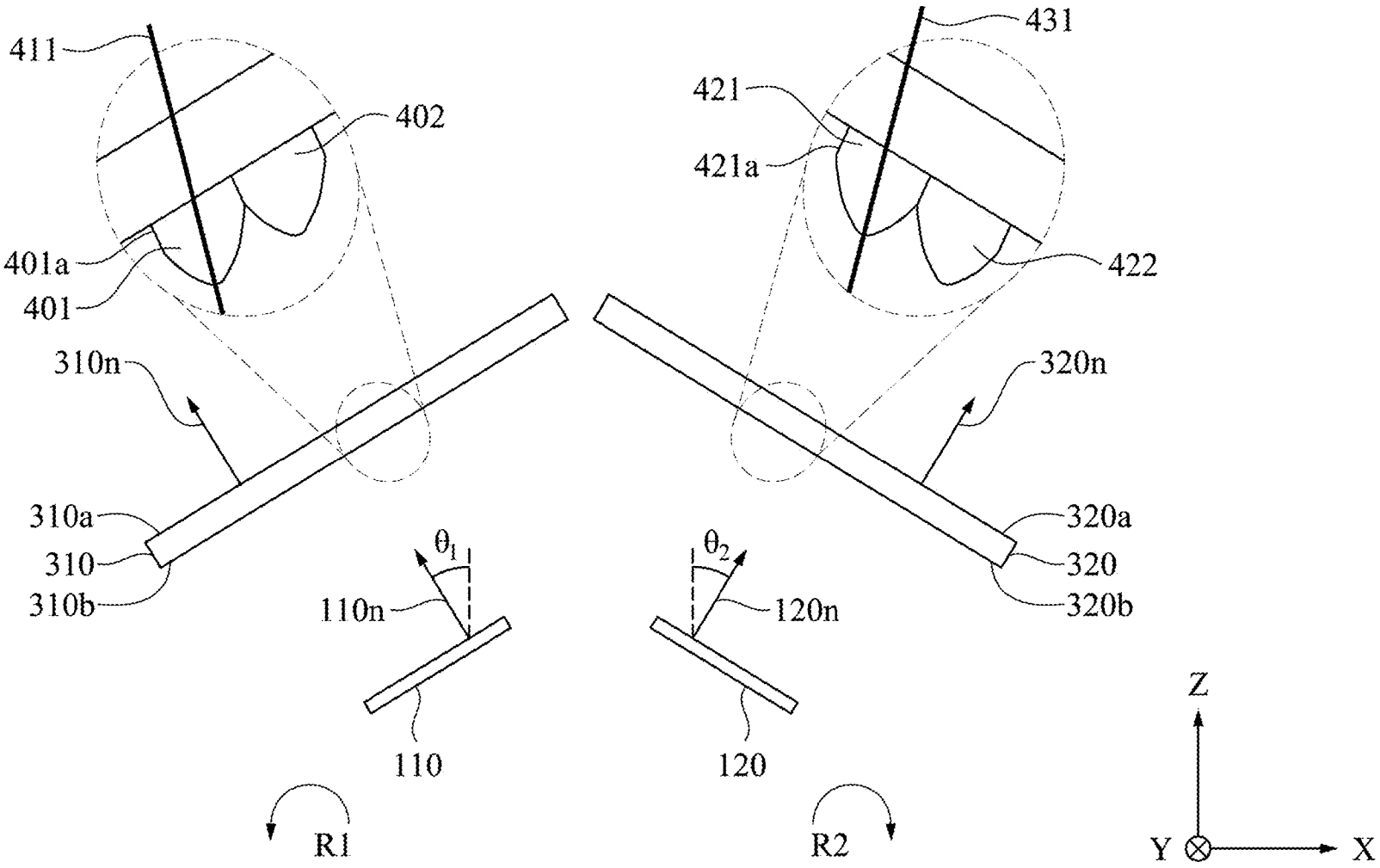
FIG. 5 is a schematic diagram of an optical apparatus in accordance with an embodiment.
Figure 6:
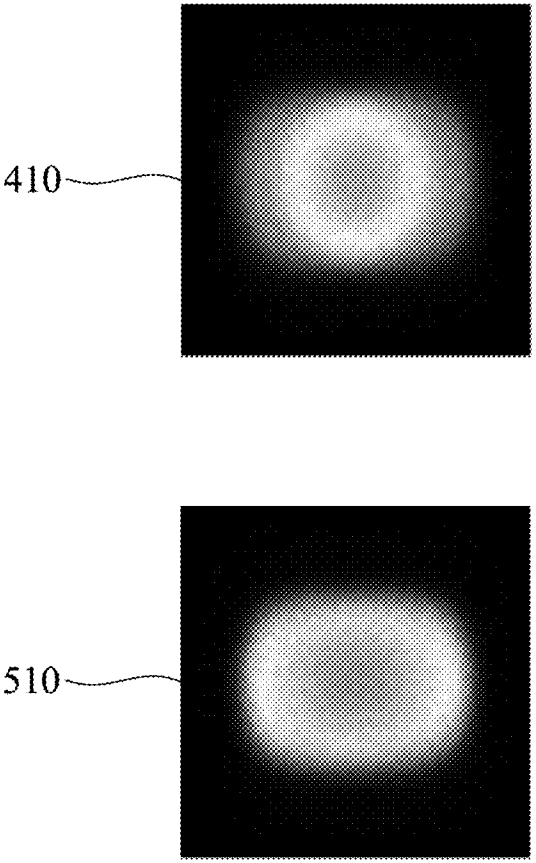
FIG. 6 is a diagram of intensity distribution of different embodiments.

An intensity distribution 410 produced by the optical apparatus of FIG. 4 is shown in FIG. 6. In the embodiment of the intensity distribution 410, $\theta_1=\theta_2=10^0$, the horizontal FOV is 116.55 degrees, and the vertical FOV is 90.18. Since the light sources and the lens units are tilted, the horizontal FOV increases (compared with the intensity distribution 210). Note that there seems to be a bright "ring" in the intensity distribution 410. In some embodiment, asymmetric micro-lens is adopted to compensate the "ring". FIG. 5 is a schematic diagram of an optical apparatus in accordance with an embodiment. The difference between FIG. 4 and FIG. 5 includes that the lens unit 310 is not identical to the lens unit 320 in FIG. 5. In detail, multiple micro-lens are formed on the incident surface 310*b* of the lens unit 310 in which an enlarged diagram of micro-lens 401 and 402 are shown in FIG. 5. The optical axis 411 of the micro-lens 401 is tilted toward the −X direction on the incident surface 310*b* (i.e. rotated along the second rotation direction R2). For example, an incident surface 401*a* of the micro-lens 401 is asymmetric with respect to the optical axis 411. Similarly, multiple micro-lens are formed on the incident surface 320*b* of the lens unit 320 in which an enlarged diagram of micro-lens 421 and 422 are shown in FIG. 5. The optical axis 431 of the micro-lens 421 is tilted toward the X direction on the incident surface 320*b* (i.e. rotated along the first rotation direction R1). For example, an incident surface 421*a* of the micro-lens 421 is asymmetric with respect to the optical axis 431. Note that after tilted, the optical axis 411 is not parallel to the normal vector 310*n*, and the optical axis 431 is not parallel to the normal vector 320*n*. An intensity distribution 510 produced by the optical apparatus of FIG. 5 is shown in FIG. 6. In the embodiment of the intensity distribution 510, $\theta_1=\theta_2=15°$, the horizontal FOV is 120.41 degrees, and the vertical FOV is 91.05 degrees. Compared with the intensity distribution 410, the intensity distribution 510 is more uniform by adopting the asymmetric micro-lens while tilting the lens units.

Although the present invention has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An optical apparatus, comprising:

a first light source having a first emitting surface;

a second light source having a second emitting surface, wherein the second light source and the first light source are arranged along a first direction; and at least one lens unit, wherein the first light source and the second light source are disposed at a same side of the at least one lens unit, and an incident surface of the at least one lens unit faces the first light source and the second light source, wherein a normal vector of the first emitting surface is tilted a first angle toward the first direction opposite to the second light source, a normal vector of the second emitting surface is tilted a second angle toward a second direction opposite to the first light source, the first direction is opposite to the second direction such that a third angle is formed between the normal vector of the first emitting surface and the normal vector of the second emitting surface, and the third angle is greater than 0 degree and less than or equal to 90 degrees.

2. The optical apparatus of claim 1, wherein the first light source and the second light source are vertical-cavity surface-emitting lasers (VCSEL), edge emitting laser or light emitting diodes, and the at least one lens unit is a micro-lens array (MLA) or a diffractive optical element (DOE).

3. The optical apparatus of claim 1, wherein the first angle is identical to the second angle, and the first angle is greater than 0 degree and less than or equal to 45 degrees.

4. The optical apparatus of claim 1, wherein the first angle is different from the second angle.

5. The optical apparatus of claim 1, wherein the at least one lens unit comprises a first lens unit and a second lens unit, the first lens unit corresponds to the first light source, and the second lens unit corresponds to the second light source.

6. The optical apparatus of claim 5, wherein a normal vector of an emitting surface of the first lens unit is tilted toward the first direction, a normal vector of an emitting surface of the second lens unit is tilted toward the second direction, a plurality of micro-lens are formed on an incident surface of the first lens unit, and an incident surface of each of the micro-lens is symmetric with respect to an optical axis of the corresponding micro-lens, wherein the first lens unit is identical to the second lens unit.

7. The optical apparatus of claim 5, wherein a normal vector of an emitting surface of the first lens unit is tilted toward the first direction, a normal vector of an emitting surface of the second lens unit is tilted toward the second direction, a plurality of first micro-lens are formed on an incident surface of the first lens unit, and an incident surface of each of the first micro-lens is symmetric with respect to an optical axis of the corresponding first micro-lens, wherein a plurality of second micro-lens are formed on an incident surface of the second lens unit, and an incident surface of each of the second micro-lens is symmetric with respect to an optical axis of the corresponding second micro-lens, wherein the first lens unit is different from the second lens unit.

8. The optical apparatus of claim 5, wherein a normal vector of an emitting surface of the first lens unit is tilted toward the first direction, a normal vector of an emitting surface of the second lens unit is tilted toward the second direction, a plurality of first micro-lens are formed on a first incident surfaces of the first lens unit, an optical axis of each of the first micro-lens is tilted toward the first direction on the first incident surface such that the optical axis of each of the first micro-lens is not parallel to the normal vector of the emitting surface of the first lens unit.

9. The optical apparatus of claim 8, wherein a plurality of second micro-lens are formed on a second incident surface of the second lens unit, an optical axis of each of the second micro-lens is tilted toward the second direction on the second incident surface such that the optical axis of each of the second micro-lens is not parallel to the normal vector of the emitting surface of the second lens unit.

10. The optical apparatus of claim 9, wherein an incident surface of each of the first micro-lens is asymmetric with respect to the optical axis of the corresponding first micro-lens, wherein an incident surface of each of the second micro-lens is asymmetric with respect to the optical axis of the corresponding second micro-lens.

* * * * *